US008477093B2

(12) United States Patent
Nam et al.

(10) Patent No.: US 8,477,093 B2
(45) **Date of Patent: *Jul. 2, 2013**

(54) DEVICE FOR ADJUSTING TRANSMISSION SIGNAL LEVEL BASED ON CHANNEL LOADING

(75) Inventors: Jang-Jin Nam, Yongin-si (KR); Yong-Weon Jeon, Suwon-si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 22 days.

This patent is subject to a terminal disclaimer.

(21) Appl. No.: 13/137,436

(22) Filed: Aug. 16, 2011

(65) Prior Publication Data

US 2012/0044236 A1 Feb. 23, 2012

Related U.S. Application Data

(63) Continuation of application No. 11/700,167, filed on Jan. 31, 2007, now Pat. No. 8,004,486.

(30) Foreign Application Priority Data

Jan. 31, 2006 (KR) ..... 10-2006-0009440

(51) Int. Cl.
*G09G 3/36* (2006.01)

(52) U.S. Cl.
USPC ..... 345/98

(58) Field of Classification Search
USPC ..... 345/84–104
See application file for complete search history.

(56) References Cited

U.S. PATENT DOCUMENTS

| | | | | |
|---|---|---|---|---|
| 6,747,417 | B2 | 6/2004 | Meade et al. | |
| 8,004,486 | B2 * | 8/2011 | Nam et al. | 345/98 |
| 2004/0100398 | A1 | 5/2004 | Lin et al. | |
| 2004/0135956 | A1 | 7/2004 | Kim et al. | |
| 2004/0150424 | A1 | 8/2004 | Wuppermann | |
| 2004/0179029 | A1 | 9/2004 | Ogawa et al. | |
| 2004/0263464 | A1 | 12/2004 | Chiu | |

FOREIGN PATENT DOCUMENTS

| | | |
|---|---|---|
| GB | 2399242 | 9/2004 |
| JP | 61-131946 | 6/1986 |
| JP | 6-214527 | 8/1994 |
| JP | 2004-317910 | 11/2004 |
| JP | 2005-156708 | 6/2005 |
| KR | 2003-0068824 | 8/2003 |
| TW | 1269264 | 12/2006 |

OTHER PUBLICATIONS

Taiwanese Office Action dated May 27, 2010 with English translation for corresponding Taiwanese Application No. 096103480.

* cited by examiner

*Primary Examiner* — Srilakshmi K Kumar
(74) *Attorney, Agent, or Firm* — Harness, Dickey & Pierce, P.L.C.

(57) ABSTRACT

A device for controlling the level of a transmission signal according to the channel loading is provided. The device may include a plurality of semiconductor devices and a controller to control the plurality of semiconductor devices. The controller may control the level of a signal to be transmitted to each of the plurality of semiconductor devices according to the channel loading on each semiconductor device.

19 Claims, 6 Drawing Sheets

TCON

| n1 | n0 | Iref | $I_{TX}$ |
|---|---|---|---|
| 0 | 0 | 1I | 1AC |
| 0 | 1 | 2I | 2AC |
| 1 | 0 | 3I | 3AC |
| 1 | 1 | 4I | 4AC |

CD2

| n1 | n0 | $I_{CD}(=I_{AC})$ |
|---|---|---|
| 0 | 0 | — |
| 0 | 1 | — |
| 1 | 0 | — |
| 1 | 1 | — |

DEVICE FOR ADJUSTING TRANSMISSION SIGNAL LEVEL BASED ON CHANNEL LOADING

PRIORITY STATEMENT

This U.S. nonprovisional application is a continuation of, and claims priority under 35 U.S.C. §120 to, U.S. application Ser. No. 11/700,167, filed Jan. 31, 2007, now U. S. Pat. No. 8,004,486 which claims priority under 35 U.S.C. §119 to Korean Patent Application No. 10-2006-0009440, filed on Jan. 31, 2006, in the Korean Intellectual Property Office (KIPO), the entire contents of each of which are incorporated herein by reference.

BACKGROUND

Example embodiments may relate to devices and methods for adjusting the level of transmission signals according to channel loading.

DESCRIPTION OF THE RELATED ART

In a structure in which a controller and a plurality of semiconductor chips are connected in a point-to-point fashion, channel loading between the controller and each semiconductor chip may vary according to the locations of the semiconductor chips (e.g., according to the distance between controller and semiconductor chip). Thus, in order to stably transmit and receive data, the driving strength of the controller may be determined with consideration of a channel onto which the greatest loading is applied. However, if the driving strength of the controller is indiscriminately determined, a signal-to-noise ratio (SNR) of even a channel onto which the smallest load is applied may be increased more than needed. Generally, the greater the number of chips, the greater the channel distance between the controller and each chip. Therefore, the controller should increase the signal level for a chip farthest from the controller in order to secure enough of a SNR to receive data. However, when signals having a similar level (which may be determined with respect to the farthest chip) are supplied to all channels, power may be wasted and/or electro-magnetic interference (EMI) may occur in chips adjacent to the controller. Additionally, the signals may not be completely transmitted to chips that are far from the controller.

SUMMARY

Example embodiments may provide devices for adjusting the level of a signal according to the loading between a controller and a chip, thereby reducing power consumption and suppressing electro-magnetic interference (EMI).

Example embodiments may provide a device for controlling the level of a transmission signal according to the channel loading is provided. The device may include a plurality of semiconductor devices and a controller to control the plurality of semiconductor devices. The controller may control the level of a signal to be transmitted to each of the plurality of semiconductor devices according to the channel loading on each semiconductor device.

According to an example embodiment, a liquid crystal display device (LCD) may include a timing controller, a plurality of column drivers, at least one gate driver, and a display panel.

The timing controller may control the level of a signal to be transmitted to the of the column drivers according to the channel loading on each column drivers. The column drivers may drive data lines. The at least one gate driver may drive gate lines. The display panel may include the data lines, the gate lines and a plurality of pixels, with each pixel present at a point where a gate line intersects a data line.

The column drivers may be divided into a plurality of groups. The first group of the plurality of groups may include a first column driver and a second column driver. The first column driver may receive a control signal and data for the second column driver from the timing controller, and may transmit them to the second column driver.

According to another example embodiment, a semiconductor device may include a plurality of semiconductor chips and a controller to control the semiconductor chips. The controller may control the level of a signal to be transmitted to the semiconductor chips based on the channel loading on the semiconductor chips.

Example embodiments will be more fully apparent from the following detailed description of example embodiments, the accompanying drawings, and the associated claims.

BRIEF DESCRIPTION OF THE DRAWINGS

Example embodiments will become more apparent by describing them in detail with reference to the attached drawings in which.

Figure 1:
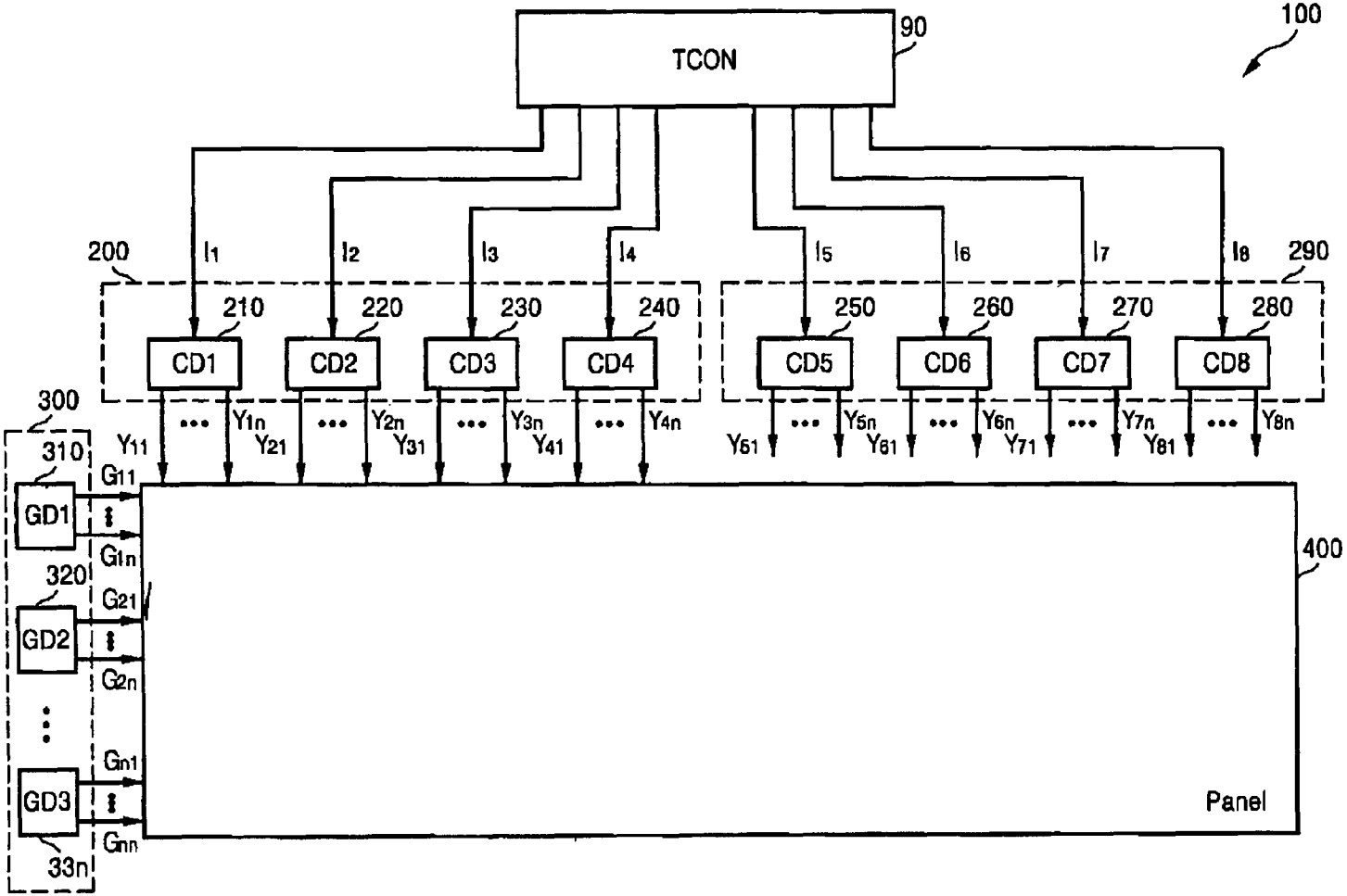
FIG. 1 is a circuit diagram of a liquid display device, according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Hereinafter, example embodiments will be described in detail with reference to the accompanying drawings. Like reference numerals denote like elements throughout the drawings.

FIG. 1 is a circuit diagram of a liquid display device (LCD) 100 according to an example embodiment. Referring to FIG. 1, the LCD 100 may include a timing controller 90, a plurality of column drivers 210, 220, . . . , 280, a gate driver unit 300 including a plurality of gate drivers 310, 320, . . . , 33*n* and a display panel 400. The display panel 400 may include a plurality of gate lines (not shown), a plurality of data lines (not shown), and a plurality of pixels (not shown), each pixel of the plurality of pixels being located at a point at which a gate line intersects a data line.

The timing controller 90 may control the level of a signal to be transmitted to each of the column drivers 210, 220, . . . , 280, based on the channel loading between the timing controller 90 and each of the column drivers 210, . . . , 280, respectively.

In an example embodiment, the timing controller 90 may transmit a control signal and source data (e.g., image data) to each of the column drivers 210, 220, . . . , 280 by using a current signal. Thus, the timing controller 90 may control the level of the current signal to be transmitted. However, example embodiments are not limited to controlling the level of the current signal. In at least one example embodiment, the level of a voltage signal may be controlled to transmit the control signal and the source data.

Different channel loadings are applied onto the column drivers 210, 220, . . . , 280 according to their distances from the timing controller 90. That is, the farther the distance between the column driver 210, 220, . . . , or 280 and the timing controller 90, the greater the channel loading. The greater the channel loading on the column driver 210, 220, . . . , or 280, the more the level of the signal to be transmitted may be increased by the timing controller 90. That is, the signal level may be proportional to the distance between the timing controller 90 and each of the column drivers 210, 220, . . . , 280. The column drivers 210, 220, . . . , 280 may be divided into a first source driver group 200 that drives a part of the panel 400, and a second source driver group 290 that drives the other part of the panel 400.

The first through fourth column drivers 210, 220, 230, and 240, belonging to the first source driver group 200, respectively receive signals whose levels may be controlled according to their distances from the timing controller 90. The fifth through eighth drivers 250, . . . , 280, belonging to the second source driver group 290, may operate similarly to the first source driver group 200. The first and eighth column drivers 210 and 280 may be respectively located adjacent to the sides of the timing controller 90, may be spaced a similar distance from the timing controller 90, may receive signals having a similar level, and may drive a plurality of data lines $Y_{11}, \ldots, Y_{1n}, Y_{81}, \ldots, Y_{8n}$, respectively.

Similarly, the fourth and fifth column drivers 240 and 250 may be located adjacent to the sides of the timing controller 90, may be spaced a similar distance from the timing controller 90, may receive signals having the a similar level, and may drive a plurality of data lines $Y_{41}, \ldots, Y_{4n}$, and $Y_{51}, \ldots, Y_{5n}$, respectively. In this manner, the first through eight column drivers 210, . . . , 280 may receive signals having different levels determined according to their distances from the timing controller 90, and may drive the corresponding data lines $Y_{11}, \ldots, Y_{1n}, \ldots, Y_{81}, \ldots, Y_{8n}$ accordingly.

Gate drivers 310, 320, . . . , 33*n* may output gate line driving signals for driving gate lines $G_{11}$ through $G_{1n}$, . . . , $G_{n1}$ through $G_{nm}$, based on the control signals and gate turn-on/turn-off voltages (not shown). The number of the column drivers 210, . . . , 280 and the number of the gate drivers 310, 320, . . . , 33*n* may be increased or decreased. The panel 400 may display image data in response to the data line driving signals and the gate line driving signals. In an example embodiment, for example as illustrated in FIG. 1, the timing controller 90 may be connected to each of the column drivers 210, . . . , 280 in a point-to-point fashion.

Figure 2:
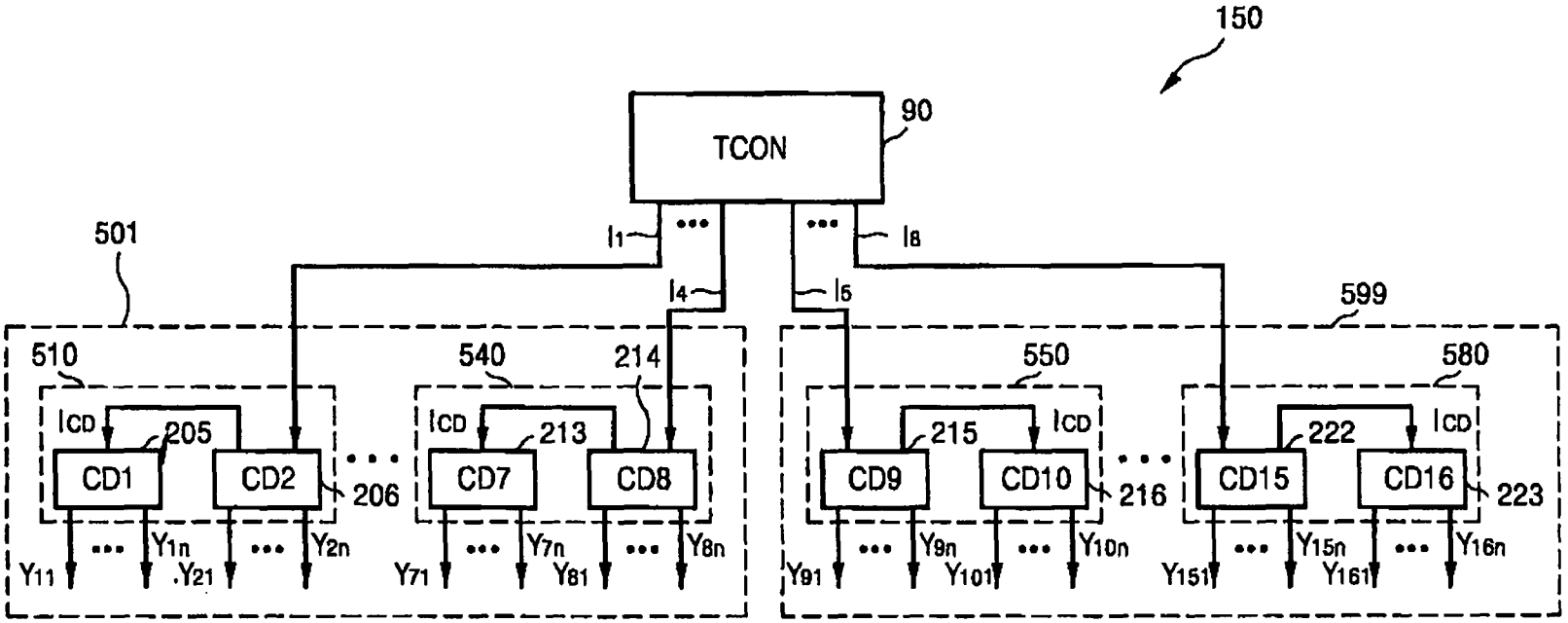
FIG. 2 is a circuit diagram illustrating a timing controller and a column driver, according to an example embodiment.

FIG. 2 is a block diagram of an LCD 150 according to an example embodiment. Referring to FIG. 2, the LCD 150 may include a timing controller 90 and a plurality of column drivers 205, 206, . . . , 223. Although not shown in FIG. 2, the LCD 150 according to an example embodiment may also include the gate driver unit 300 and the panel 400 illustrated in FIG. 1.

Different channel loadings may be applied onto the column drivers 205, 206, . . . , 223 according to their distances from the timing controller 90. The column drivers 205, 206, . . . , 223 may be divided into several groups 510 through 580 by two column driver units per group. The first group 510 may include a first column driver CD1 and a second column driver CD2. Although not shown, a second group may include a third column driver and a fourth column driver. In this way, the first through sixteenth column drivers CD1 through CD16 may be divided into eight groups 510, . . . , 540, 550, . . . , 580. The number of the column drivers 205, 206, . . . , 223, and the number of the column driver groups may also be increased or decreased, and thus the particular number of column groups shown should not be limiting.

The first through fourth groups 510 through 540 may drive a part of the panel 400, and the fifth through eighth groups 550 through 580 may drive the other part of the panel 400 (not shown). One column driver included in each of the groups 510, . . . , 540, 550, . . . , 580 (e.g. the column drivers 206, 214, 215, and 222), may be connected to the timing controller 90 in a point-to-point fashion. The other column drivers 205, 213, 216, and 223 of the groups 510, . . . , 540, 550, . . . , 580 may be connected to the column drivers 206, 214, 215, and 222 of the groups 510, . . . , 540, 550, . . . , 580 in a cascade fashion.

The timing controller 90 may adjust the levels of current signals I1 through I8 according to the channel loadings on the column drivers 206, 214, 215, and 222 connected to the timing controller 90 in the point-to-point fashion, respectively, and may output the current signals $I_1$ through $I_8$. Higher channel loadings may be applied onto the second and fifteenth column drivers 206 and 222 of the column drivers 206, 214, 215, and 222 connected to the timing controller 90 in the point-to-point fashion, and smaller channel loadings may be applied onto the eighth and ninth column drivers 214 and 215.

The second column driver 206 may receive a control signal and data which is to be transmitted to the first column driver 205 from the timing controller 90. In this example, the second column driver 206 may transmit a column reference current signal $I_{CD}$ that may be inversely proportional to the current signal $I_1$. In this way, the column drivers 206, 214, 215, and 222 of the first through eighth groups 510 through 580, which are connected to the timing controller 90 in the point-to-point fashion, may receive the current signals $I_1$ through $I_8$ and may transmit column reference current signals $I_{CD}$. The levels of the column reference current signals $I_{CD}$ may be respectively inversely proportional to those of the current signals $I_1$ through $I_8$. The column drivers 206, 214, 215, and 222 may transmit the column reference current signals $I_{CD}$ to the column drivers 205, 213, 216, and 223.

Transmitting/receiving of a reference current signal between the second column driver 206 and the first column driver 205 will later be described in greater detail.

Figure 3:
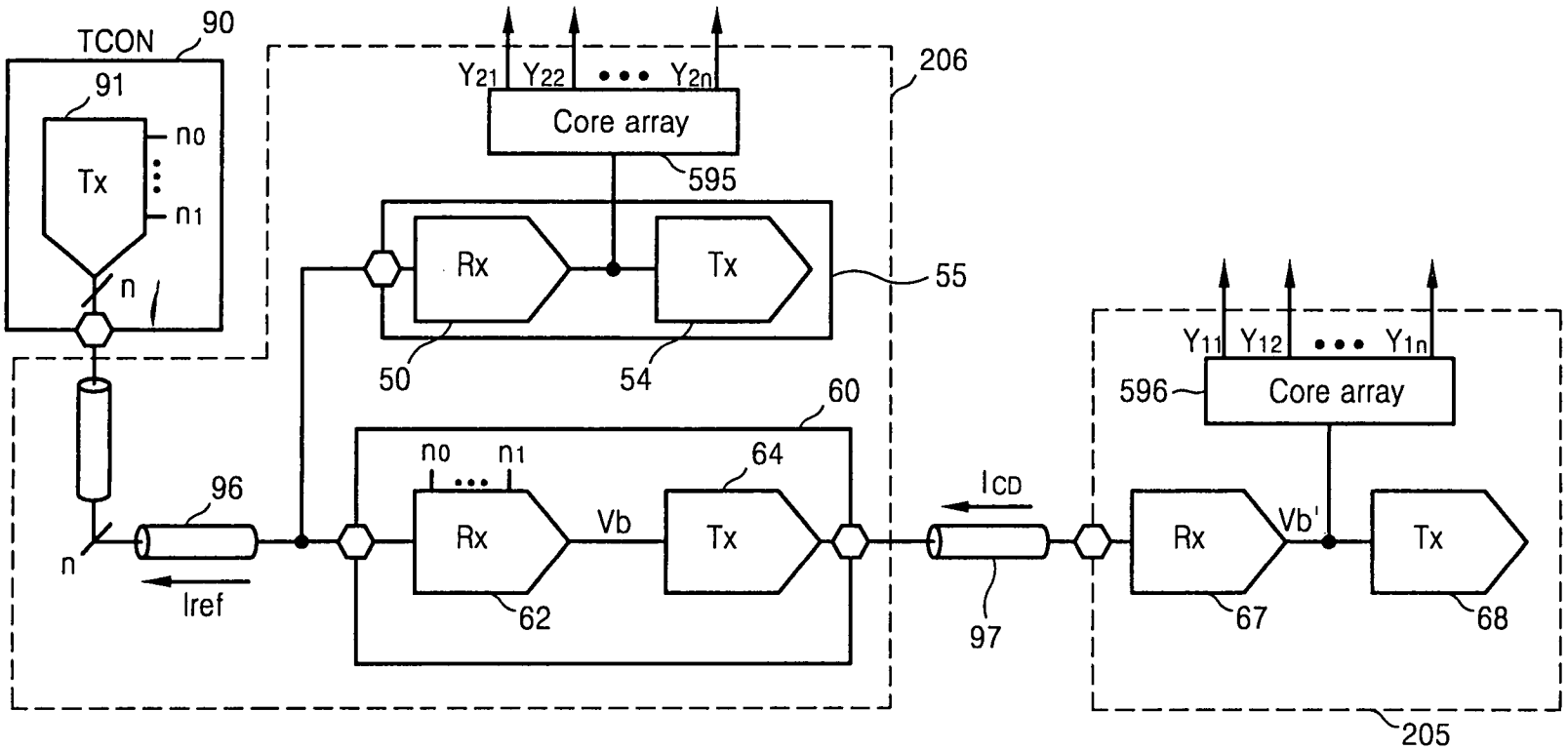
FIG. 3 is an internal block diagram of a timing controller and a column driver, according to an example embodiment.

FIG. 3 is an internal block diagram of a timing controller 90 and column drivers 205 and 206 according to an example embodiment. Referring to FIG. 3, the timing controller 90 may include a transmitting unit 91. For convenience of explanation, FIG. 3 illustrates that the timing controller 90 may include the transmitting unit 91, but may substantially include transmitting units corresponding to column drivers (or groups of column drivers) and each transmitting unit may control the level of a transmission signal. Also, the timing controller 90 may include a processor or a CPU (not shown) that controls the overall operations of the timing controller 90 and generates control signals $n_0$ and $n_1$ for controlling the levels of the transmission signals output from the transmitting units.

The second column driver 206 may include a first transceiving unit 55, a second transceiving unit 60, and a core array 595. The first transceiving unit 55 may include a first receiving unit (Rx) 50 and a first transmitting unit (Tx) 54. The second transceiving unit 60 may include a second receiving unit (Rx) 62 and a second transmitting unit (Tx) 64.

Figure 5A:
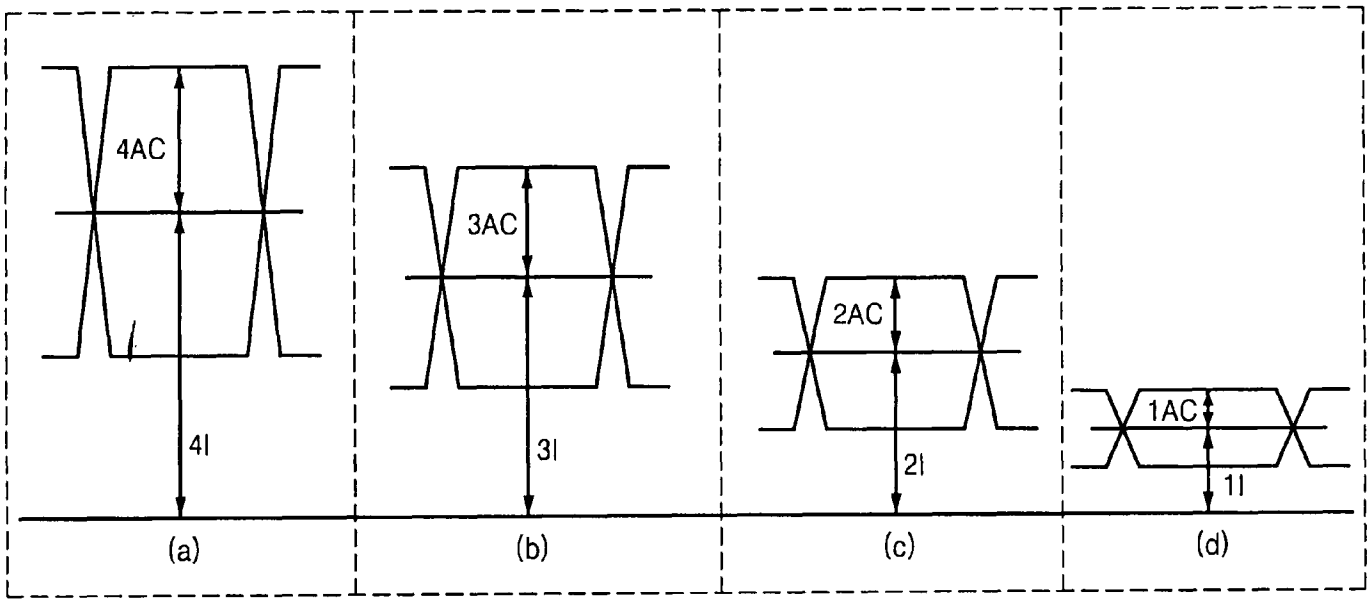
FIGS. 5A and 5B illustrate current signal levels according to the values of control signals, according to an example embodiment.

The first column driver 205 may include a third receiving unit 67, a third transmitting unit 68, and a core array 596. Although not shown, the core arrays 595 and 596 may include a shift register, a latch, a digital-to-analog converter (ADC), and an output buffer. The transmitting unit 91 of the timing controller 90 may control the level of a reference current signal Iref and may transmit it in response to the control signals $n_0$ and $n_1$. The reference current signal Iref may be a DC current signal used as a reference signal to receive a data current signal $I_{TX}$ (not shown) transmitted from the timing controller 90 to each column driver. The data current signal $I_{TX}$ may oscillate with a chosen amplitude from the reference current signal Ire as illustrated in FIG. 5A. The first and second receiving units 50 and 62 may receive the reference current signal Iref. The first receiving unit 50 may drive the core array 595. The first transmitting unit 54 may not receive the reference current signal Iref, and may operate when the number of column drivers connected to the second column driver 206 in the cascade fashion increases. The second receiving unit 62 may receive the control signals $n_0$ and $n_1$ that may be the same as those supplied to the transmitting unit 91. In response to the control signals $n_0$ and $n_1$, the second receiving unit 62 may generate a first bias signal Vb whose level may be inversely proportional to that of the reference current signal Iref. The second transmitting unit 64 may generate a column reference current signal $I_{CD}$ based on the first bias signal Vb, and may supply it to the first column driver 205 via a second channel 97.

The third receiving unit 67 may receive the column reference current signal $I_{CD}$ via the second channel 97 and may transform it into a second bias voltage Vb'. The third transmitting unit 68 may not receive the second bias voltage Vb', and may operate when the number of column drivers in a corresponding column driver group increases and column drivers connected to the first column driver 205 in the cascade fashion are present.

Figure 4:
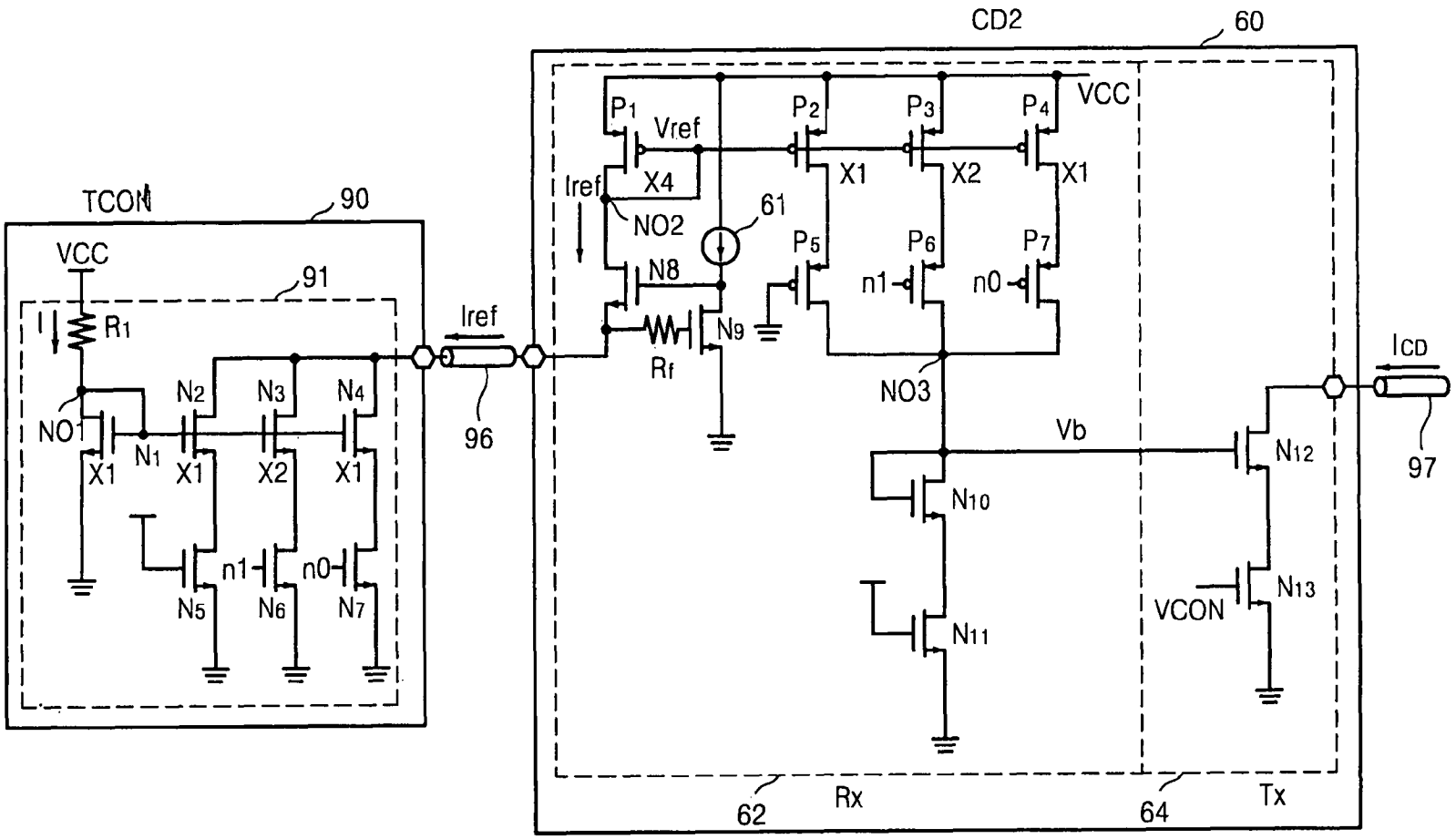
FIG. 4 is an internal circuit diagram of a timing controller and a transceiver unit of a column driver, according to an example embodiment.

FIG. 4 is an internal circuit diagram of the timing controller 90, and the second transceiving unit 60 of the second column driver 206 illustrated in FIG. 3, according to an example embodiment. Referring to FIG. 4, the transmitting unit 91 of the timing controller 90 may include a first resistor R1 and a plurality of NMOS transistors $N_1, \ldots, N_7$. The second receiving unit 62 of the second column driver 206 may include a plurality of PMOS transistors $P_1, \ldots, P_7$, and a plurality of NMOS transistors $N_8$ through $N_{11}$. The second transmitting unit 64 of the second column driver 206 may include a plurality of NMOS transistors $N_{12}$ through $N_{13}$. In the transmitting unit 91, the first NMOS transistor $N_1$ may be connected to the second through fourth NMOS transistors $N_2$ through $N_4$ in the form of a current mirror. If current flowing through a first output node NO1 from a supply voltage source VCC via the first resistor R1 is I, a reference current signal Iref can be controlled by adjusting a ratio of the size of the first NMOS transistor $N_1$ (a ratio of a width to a length W/L) to the sizes of the second through fourth NMOS transistors $N_2$ through $N_4$. In this example, the ratio of the size X1 of the first NMOS transistor $N_1$ to the sizes X1, X2, and X1 of the second through fourth NMOS transistors $N_2$ through $N_4$ may be 1:2:1 (e.g., X1:X2:X1 may be 1:2:1).

While the fifth NMOS transistor $N_5$ is turned on, the sixth and seventh NMOS transistors $N_6$ and $N_7$ may be respectively turned on/off in response to control signals $n_1$ and $n_0$. Thus, the level of the reference current signal Iref may be controlled in response to the control signals $n_1$ and $n_0$.

Hereinafter, the second receiving unit 62 of the second transceiving unit 60 will be described in greater detail.

The first PMOS transistor $P_1$ may be connected to the second through fourth PMOS transistors $P_2$ through $P_4$ in the form of the current mirror. It may be possible to control the amount of current flowing through a third output node NO3 according to the reference current signal Iref by adjusting the ratio of the size X4 of the first PMOS transistor $P_1$ (the ratio of W/L) to the sizes X1, X2, and X1 of the second through fourth PMOS transistors $P_2$ through $P_4$. For example, the ratio of the size X4 of the first PMOS transistor $P_1$ to the sizes X1, X2, and X1 of the second through fourth PMOS transistors $P_2$ through $P_4$ may be 1/4:2/4:1/4. That is, if the size X4 of the first PMOS transistor $P_1$ is 4, the sizes X1, X2, and X1 of the second through fourth PMOS transistors $P_2$ through $P_4$ are 1, 2, and 1.

While the fifth PMOS transistor $P_5$ is turned on, the sixth and seventh PMOS transistors $N_6$ and $N_7$ may be turned on/off in response to the control signals $n_1$ and $n_0$, respectively. Thus, the amount of current flowing through the third output node NO3 may be controlled in response to the control signals $n_1$ and $n_0$.

For example, when the control signals $n_1$ and $n_0$ having values of (1, 1) are input, the reference current signal Iref flowing through the first PMOS transistor $P_1$ is 41. Therefore, the fifth PMOS transistor P5 may be turned on and the sixth and seventh PMOS transistors $P_6$ and $P_7$ may be turned off. Thus, the reference current signal Iref flowing through the third output node NO3 is 1I. Because a first bias voltage Vb may also be changed according to the current flowing through the third output node NO3, the first bias voltage Vb may also be controlled in response to the control signals $n_1$ and $n_0$.

The eighth NMOS transistor $N_8$ may be connected to the timing controller 90 via a channel 96 to receive the reference current signal Iref from the controller 90. The ninth NMOS transistor $N_9$ may embody a type of an amplifier that gives negative feedback to an input node so as to reduce a source resistance in the eighth NMOS transistor $N_8$. A current source 61 may supply a bias current to the ninth NMOS transistor $N_9$.

In an example embodiment, the timing controller 90 may control a signal level for each of four groups (e.g., 2*2=4) of column drivers, thus the control signals $n_1$ and $n_0$ may represent 2 bits or more (e.g., 2^2=4). Additional bits may be allocated for more precise control. The tenth NMOS transistor $N_{10}$ may be located between the third output node NO3 and the eleventh NMOS transistor $N_{11}$, and connected to the twelfth NMOS transistor $N_{12}$ in the form of the current mirror. The twelfth NMOS transistor $N_{12}$ may be located between the second channel 97 and the thirteenth NMOS transistor $N_{13}$. When power is supplied to the eleventh NMOS transistor $N_{11}$, it may be turned on. The thirteenth NMOS transistor $N_{13}$ may be turned on/off in response to a control signal VCON. For example, when the thirteenth NMOS transistor $N_{13}$ is turned off, the column reference current signal $I_{CD}$ may be not generated. However, the column reference current signal $I_{CD}$ may be generated after the thirteenth NMOS transistor $N_{13}$ is turned on. In this manner, the thirteenth NMOS transistor $N_{13}$ may control whether to generate a column reference current signal $I_{CD}$.

Figure 5B:
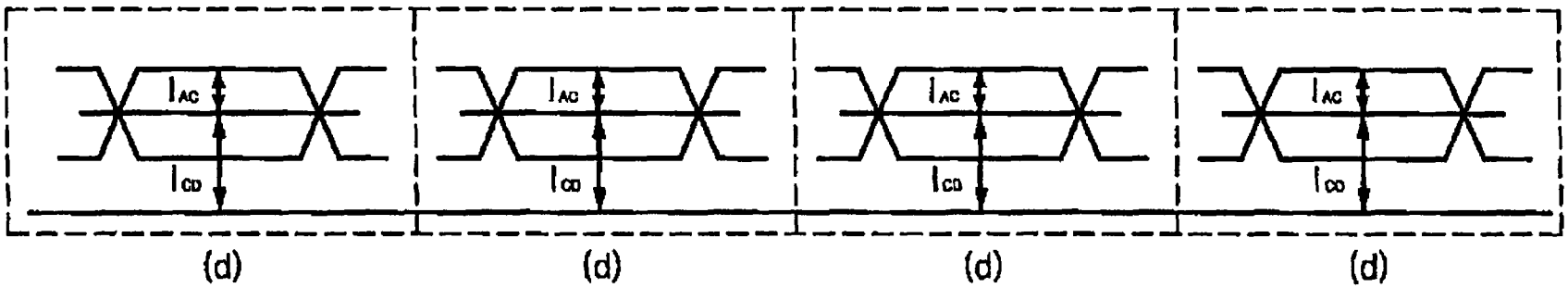

FIGS. 5A and 5B are tables and graphs illustrating current levels in response to control signals $n_1$ and $n_0$, according to an example embodiment. FIG. 5A may illustrate the levels of a reference current signal Iref and a data current signal $I_{TX}$ according to the control signals $n_1$ and $n_0$ supplied to an example timing controller. For convenience of explanation, referring to FIG. 4, the transmitting unit 91 of the timing controller 90 may receive the control signals $n_1$ and $n_0$, and may output signals whose levels may be inversely proportional to channel loadings on column drivers. For example, (a) of FIG. 5A illustrates the data current $I_{TX}$ and the reference current signal Iref output from the timing controller 90 when the channel loading is the greatest (e.g., when the values of the control signals $n_1$ and $n_0$ are (1,1)). In another example, (b) of FIG. 5A illustrates the data current signal $I_{TX}$ and the reference current signal Iref when the values of the control signals $n_1$ and $n_0$ are (1, 0). In another example, (c) of FIG. 5A illustrates the data current signal $I_{TX}$ and the reference current signal Iref when the values of the control signals $n_1$ and $n_0$ are (0,1). In yet another example, (d) of FIG. 5A illustrates the data current signal $I_{TX}$ and the reference current signal Iref when the values of the control signals $n_1$ and $n_0$ are (0,0).

From the graphs and tables illustrated in FIG. 5A, it is noted that the data current $I_{TX}$ may be controlled from a 1AC level to a 4AC level and the reference current signal Iref may be controlled from an I level to a 4I level according to the channel loading. Although FIG. 5A has been described using these particular values for $n_1$ and $n_0$, it will be understood that any other representation of $n_1$ and $n_0$ could be used without departing from the scope of example embodiments.

FIG. 5B illustrates the levels of a column reference current signal $I_{CD}$ and a data current signal $I_{AC}$ transmitted from the second receiving unit 62 to the second transmitting unit 64 according to the control signals $n_1$ and $n_0$. For convenience of explanation, referring to FIG. 4, the second receiving unit 62 may generate the column reference current signal $I_{CD}$ whose level may be inversely proportional to that of the reference current signal Iref received from timing controller 90. Thus, the column reference current signal $I_{CD}$ generated by the second receiving unit 62 may be maintained near a constant level regardless of the level of the reference current signal Iref.

In example embodiments, the level of a signal may be determined and the exchange of current signals may be controlled according to the channel loading on a column driver of an LCD, but the present invention is not limited to these embodiments. Example embodiments are applicable not only to an LCD but also a method of controlling signals to be exchanged between a memory controller and a plurality of semiconductor chips. For example, it is possible to allow a memory controller to respectively supply signals having different levels to a plurality of semiconductor chips onto which different channel loadings are applied, each signal level being determined according to the channel loading. In this example, a current signal may be used as a voltage signal. If the voltage signal is transmitted, the voltage level of the voltage signal may be controlled according to the channel loading.

As described above, it may be possible to control the level of a signal according to the loading between a controller and a semiconductor chip, thereby reducing consumption of current and the EMI.

With some example embodiments having thus been described, it will be obvious that the same may be varied in many ways. Such variations are not to be regarded as a departure from the spirit and scope of the present invention, and all such modifications are intended to be included within said scope, as set forth in the following claims.

What is claimed is:

1. A display device comprising:

a plurality of display driver integrated circuit (IC) devices; and a controller configured to control the plurality of display driver IC devices; wherein for each of the plurality of display driver IC devices, the controller is configured to independently control a level of a signal to be transmitted to the display driver IC device based on a channel loading between the controller and the display driver IC device, the channel loading being based on a distance between the controller and the display driver IC device.

2. The display device of claim 1, wherein the controller is configured to control levels of a data current signal and a reference current signal in response to a control signal, and wherein the controller is configured to transmit the data current signal and the reference current signal.

3. The display device of claim 2, wherein a first display driver IC device among the plurality of display driver IC devices is connected to the controller in a point-to-point fashion, and a second display driver IC device among the plurality of display driver IC devices is connected to the first display driver IC device in a cascade fashion.

4. The display device of claim 3, wherein the first display driver IC device is configured to generate a cascade signal at a constant level, and the first display driver IC device is configured to transmit the cascade signal to the second display driver IC device.

5. The display device of claim 3, wherein the plurality of display driver IC devices are divided into at least one group, the at least one group being one of a plurality of groups of display driver IC devices and including the first display driver IC device and the second display driver IC device.

6. The display device of claim 1, wherein the controller is configured to control the level of the signal, and to transmit the signal in response to a control signal.

7. The display device of claim 6, wherein a first display driver IC device among the plurality of display driver IC devices is connected to the controller in a point-to-point fashion, and a second display driver IC device among the plurality of display driver IC devices is connected to the first display driver IC device in a cascade fashion.

8. The display device of claim 7, wherein the first display driver IC device is configured to generate a cascade signal at a constant level, and the first display driver IC device is configured to transmit the cascade signal to the second display driver IC device.

9. The display device of claim 7, wherein the plurality of display driver IC devices are divided into at least one group, the at least one group being one of a plurality of groups of display driver IC devices and including the first display driver IC device and the second display driver IC device.

10. The display device of claim 1, further comprising:

a display panel including a plurality of gate lines, a plurality of data lines, and a plurality of pixels, each of the plurality of pixels being located at a corresponding intersection of a gate line and a data line; and at least one gate driver configured to drive the plurality of gate lines.

11. The display device of claim 10, wherein the plurality of display driver IC devices are a plurality of column drivers configured to drive the plurality of data lines, the controller is a timing controller configured to control the plurality of column drivers, and the timing controller is configured to control the level of the signal to be transmitted to each of the plurality of column drivers based on the channel loading between the timing controller and each of the plurality of column drivers.

12. The display device of claim 11, wherein the timing controller is configured to control levels of a data current signal and a reference current signal in response to a control signal, and the timing controller is configured to transmit the data current signal and the reference current signal.

13. The display device of claim 12, wherein a first column driver among the plurality of column drivers is configured to receive a data current signal and a reference current signal for a corresponding second column driver among the plurality of column drivers from the timing controller, and the first column driver is configured to transmit the data current signal and the reference current signal to the second column driver.

14. The display device of claim 1, wherein the controller comprises:

a processor configured to generate a control signal to control the level of the signal to be transmitted to each of the plurality of display driver IC devices based on the channel loading between the controller and each of the plurality display driver IC devices; and a plurality of transmitting units, each of the plurality of transmitting units being configured to control the level of the signal and to transmit the controlled signal to a corresponding display driver IC device in response to the control signal.

15. A display device comprising:

a display panel including a plurality of gate lines, a plurality of data lines, and a plurality of pixels, each of the plurality of pixels being located at a corresponding intersection of a gate line and a data line;

at least one gate driver configured to drive the plurality of gate lines;

a plurality of column drivers configured to drive the plurality of data lines; and a timing controller configured to independently control a level of a signal to be transmitted to each of the plurality of column drivers based on a channel loading between the timing controller and each of the plurality of column drivers, the channel loading being based on a distance between the timing controller and each of the plurality of column drivers; wherein the timing controller is configured to control levels of a data current signal and a reference current signal in response to a control signal, the timing controller is configured to transmit the data current signal and the reference current signal, a first column driver among the plurality of column drivers is configured to receive a data current signal and a reference current signal for a corresponding second column driver among the plurality of column drivers from the timing controller, the first column driver is configured to transmit the received data current signal and the received reference current signal to the corresponding second column driver, and the first column driver is configured to generate a column reference current signal having a level that is inversely proportional to a level of the reference current signal received from the timing controller, the first column driver being further configured to transmit the column reference current signal to the second column driver.

16. The display device of claim 15, wherein the column reference current signal has a constant level.

17. The display device of claim 15, wherein the first column driver comprises:

a receiving unit configured to receive the reference current signal from the timing controller; and a transmitting unit configured to control the level of the reference current signal and transmit the controlled reference current signal to the corresponding second column driver in response to the control signal.

18. A controller to control a plurality of display driver integrated circuit (IC) devices, the controller comprising:

a processor configured to generate a control signal to independently control a level of a signal to be transmitted to each of the plurality of display driver IC devices; and a plurality of transmitting units, each of the plurality of transmitting units being configured to control the level of the signal, and to transmit the controlled signal to a corresponding display driver IC device in response to the control signal; wherein for each of the plurality of display driver IC devices, the level of the signal to be transmitted to the display driver IC device is independently controlled according to a channel loading between the controller and the display driver IC device, the channel loading being based on a distance between the controller and the display driver IC device.

19. The controller of claim 18, wherein at least some of the plurality of display driver IC devices are different distances from the controller, and a different channel loading is applied to each of the plurality of display driver IC devices based on the distance between the controller and the display driver IC device.

* * * * *